United States Patent [19]

Jensen et al.

[11] Patent Number: 4,508,036

[45] Date of Patent: Apr. 2, 1985

[54] TRAINING CARTRIDGE WITH SYNTHETIC RESIN PROJECTILE OR DUMMY PROJECTILE

[75] Inventors: Ernst Jensen; Jürgen Knappworst; Rudolf Stahlmann, all of Fürth, Fed. Rep. of Germany

[73] Assignee: Dynamit Nobel Aktiengesellschaft, Troisdorf, Fed. Rep. of Germany

[21] Appl. No.: 542,585

[22] Filed: Oct. 17, 1983

[30] Foreign Application Priority Data

Oct. 15, 1982 [DE] Fed. Rep. of Germany ..... 3238268

[51] Int. Cl.[3] ..... F42B 00/00

[52] U.S. Cl. ..... 102/444; 102/501; 102/529

[58] Field of Search ..... 102/430, 444, 464–470, 102/501, 529

[56] References Cited

U.S. PATENT DOCUMENTS

| | | | |
|---|---|---|---|
| 3,034,433 | 5/1962 | Gronn | 102/464 |
| 3,732,826 | 5/1973 | Johnson | 102/444 |
| 4,142,466 | 3/1979 | Ballreich et al. | 102/513 |

FOREIGN PATENT DOCUMENTS

| | | | |
|---|---|---|---|
| 82834 | 3/1964 | France | 102/466 |
| 1442940 | 5/1966 | France | 102/444 |
| 997628 | 7/1965 | United Kingdom | 102/444 |

*Primary Examiner*—Harold J. Tudor

*Attorney, Agent, or Firm*—Antonelli, Terry & Wands

[57] ABSTRACT

A training cartridge has a synthetic resin projectile or dummy projectile wherein the projectile or dummy projectile is integrally molded to a synthetic resin sleeve or tube open at the rear end. The sleeve is inserted from the front end of a cartridge case of metal that is open at its front end. The sleeve is held within the cartridge case by drawing the cartridge case inwards, after insertion of the synthetic resin sleeve, in its frontal zone to form a conical case shoulder and a cylindrical case neck, which shoulder and neck encompass the synthetic resin sleeve in firm contact therewith. This arrangement achieves clean separation of the projectile from the remainder of the synthetic resin sleeve and/or avoids uncontrolled tearing off of parts of the synthetic resin sleeve.

6 Claims, 2 Drawing Figures

TRAINING CARTRIDGE WITH SYNTHETIC RESIN PROJECTILE OR DUMMY PROJECTILE

Figure 1:
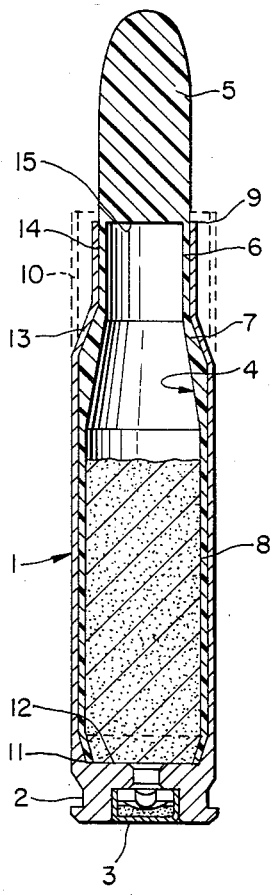

The invention relates to a training cartridge having a projectile (solid) or dummy projectile (hollow) made of synthetic resin integrally formed on a synthetic resin sleeve that is open at its rear end and that is inserted into a metal cartridge case.

Training cartridges with a synthetic resin projectile are known with various designs. A cartridge has become widely popular which includes a bottom piece of metal and a tubular cartridge body with an integrally formed synthetic resin projectile. During firing, the projectile tears off at the mouth of the tube and is driven by itself through the barrel of the firearm. Furthermore, training cartridges are conventional wherein a synthetic resin projectile is placed on a cartridge case made of metal, or is inserted therein. Both arrangements exhibit advantages and drawbacks. In the former case, the relatively low durability of the synthetic resin sleeve and in the latter case, the insecure seating of the plastic projectile in the metallic tube are features which, under certain circumstances, do not fully satisfy the requirements posed in an individual situation and which can cause feeding problems in the firearm and/or reduced firing accuracy.

Furthermore, a training cartridge is known wherein a synthetic resin sleeve is inserted in a metallic cartridge case open at the front end. The synthetic resin sleeve is open at the rear end and provided at the front end with a hollow dummy projectile which bursts at the tip during firing. The synthetic resin sleeve is in uniform contact with the inner wall of the cartridge case and is held in the case by flanging the front edge of the cartridge case over against an annular bead of the synthetic resin sleeve to form a case shoulder. It has been found, however, this arrangement can result under unfavorable circumstances during firing in irregular tearing off in the zone of the dummy projectile, or also in a "shooting" of the synthetic resin sleeve out of the metallic cartridge. Corresponding disadvantages were found when a synthetic resin projectile to be separated is provided in place of the dummy projectile.

This invention is based on the object of fashioning a training cartridge of the type having a synthetic resin projectile or dummy projectile integrally formed with a hollow sleeve that is inserted and held within a metal cartridge case in such a way that, in particular, firing accuracy and firearm function are improved.

The object has been attained, according to this invention, by a construction wherein the cartridge case is extended in the forward direction and after insertion of the synthetic resin sleeve is drawn inwards in a frontal zone into a conical case shoulder and an at least substantially cylindrical case neck, the shoulder and the neck together encompass the synthetic resin sleeve in close contact. The extension of the metallic cartridge case, according to this invention, which case after insertion of the synthetic resin sleeve has been shaped into the cylindrical case neck, advantageously provides clean separation of the projectile from the case neck of the synthetic resin sleeve, even under very adverse circumstances, whereby good firing accuracy of the synthetic resin projectile is achieved. Furthermore, tearing off of parts of the case neck or of the propellant charge powder chamber of the synthetic resin sleeve during firing is avoided; these parts could, for example, contaminate the firearm, block the firearm functionally, or damage the firearm. Analogous advantages apply to a training cartridge wherein a dummy projectile bursting at the tip, which remains joined to the synthetic resin sleeve during firing, is provided in place of the projectile which is torn off and fired from the weapon.

This effect of the cylindrical case neck was encountered unexpectedly since it was impossible to foresee how this addition, cylindrical cartridge case section could favorably affect the behavior of the synthetic resin sleeve during firing; i.e., its disintegration ability.

Figure 2:
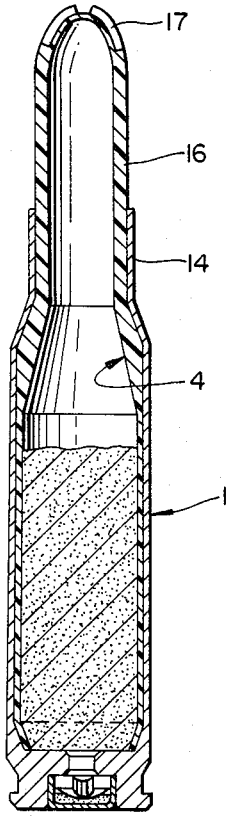

The invention is illustrated in the drawings in connection with two embodiments and is described hereinafter in greater detail with reference thereto. The drawings are longitudinal sectional views wherein:

FIG. 1 illustrates a training cartridge with a synthetic resin projectile; and FIG. 2 shows a training cartridge with a synthetic resin dummy projectile.

The cartridge case 1 made of metal, such as brass, steel, or aluminum, comprises, as shown in FIG. 1, at the bottom an extractor groove 2 and an inserted primer device 3. The external shape of the case is cylindrical or slightly conical.

A one-piece synthetic resin sleeve 4 made, for example, of polyethylene or polypropylene, has at a front end, a portion shaped as a solid synthetic 5, of correct caliber, followed toward the rear end by a molded-on neck portion 6, a shoulder portion 7 and a portion defining a propellant charge powder chamber 8. The sleeve 4 is inserted in the cartridge case 1 through the case neck 9 thereof with the forward, extended zone 10 of this neck still being in the shape indicated in dashed lines and the open end 11 of the sleeve is in contact with the internal bottom 12 of the cartridge case 1.

After insertion of the synthetic resin sleeve 4, the zone 10 of the cartridge case 1 is shaped; i.e., drawn inwards, with the formation of the case shoulder 13 and of the cylindrical or optionally also slightly conical case neck 14, whereby the illustrated, final cartridge configuration is obtained. The zone 10 of the cartridge case is dimensioned preferably to be so long that this zone encompasses, with the case neck 14, the synthetic resin sleeve hollow portion 6 over the entire length thereof; i.e., terminates with its case orifice 9 at least substantially flush with the rear end 15 of the projectile 5. This ensures an especially smooth tearing off of the projectile.

FIG. 2 shows an embodiment wherein the synthetic resin sleeve 4 has at its front end a hollow dummy projectile 16 which, during firing, conventionally burst open at the tip provided with intentional breaking lines 17. Otherwise, the arrangement of elements corresponds to the embodiment shown in FIG. 1.

The advantages attained by this invention reside in that a synthetic resin projectile, satisfying the requirements of external ballistics, in conjunction with a synthetic resin sleeve can be optimally joined to the metallic cartridge case, and clean separation of the projectile takes place at the case mouth, whereby high target accuracy is achieved. Furthermore, in this arrangement, as well as in case of a training cartridge with dummy projectile, no plastic pieces are torn off during firing from the neck/shoulder portion or from the propellant charge powder chamber, which pieces could, for example, impair the function of the firearm.

The term dummy projectile as used throughout the specification could also be designated as a simulated projectile portion. In the embodiment according to FIG. 1 the projectile 5 tears off upon firing at case orifice 9 and effects in the same manner as regular ammunition a marking at the target. In order to secure a defined tearing off of the projectile from the case orifice sleeve hollow portion 6 this training cartridge has a comparably small wall thickness in the subject section 6.

In the embodiment according to FIG. 2 the training cartridge including the dummy projectile after firing shall essentially remain an integrity. Hereby dummy projectile 16 shall only burst open along the breaking lines 17 at the tip. The wall-thickness of the synthetic resin sleeve 4 in the region of the shoulder portion 7 and the neck portion 6 throughout to the tip of the projectile is greater than that of the neck portion 6 of the cartridge according to the embodiment of FIG. 1. By the embodiment according to FIG. 2 a tearing off of dummy projectile 16 from the synthetic resin sleeve 4 is prevented. Both synthetic resin sleeves of the training cartridges according to the embodiments of FIG. 1 and FIG. 2 exhibit in the region of the conical case neck 13 increased wall-thicknesses in order to prevent tearing off of the resin sleeves in said region and also to secure a strong joint of the synthetic resin sleeve with cartridge case 1 at firing, "shooting" of the synthetic resin sleeve 4 out of the metallic cartridge 1 is securely prevented.

Usually a somewhat smaller hollow space is left above the propellant charge material than shown in each of the FIGS. 1 and 2. Upon turning of the ammunition in axial direction the propellant charge material distributes accordingly in the propellant charge powder chamber 8. It is common practice for small caliber training ammunition not to fix the propellant charge material. By suitable selection of the primer device and the propellant charge material the inner ballistic characteristics of the ammunition remain independent from the position of the propellant charge material in the cartridge.

An especially variant of the invention is a training cartridge having a plastic bullet where the neck of the jacket shell with its front edge is at least essentially flush with the rear face of the bullet.

The term "flush" means that the front edge of the neck and the rear face are located at one level. During the shooting, the bullet 5 with its ring-shaped tear-off area located at the rear face 15 is slightly radially pressed out by means of the gas pressure over the edge 9 of the neck 14 of the shell having a sharp border, and at the same time, the area of the plastic part that connects directly to the face 15 of the bullet 5 is, by means of the gas pressure, pressed radially to the outside and is sheared off by the border of the neck of the shell that acts as a shearing border. This ensures a clean and fringeless separation of the body of the plastic bullet from the tear of the plastic shell.

We claim:

1. A training cartridge equipped with a synthetic resin projectile comprising a cylindrical cartridge case made of metal which is open at a front end and closed at a bottom end and a synthetic resin solid projectile integrally formed on a synthetic resin sleeve open at its rear end; said sleeve being inserted in the cartridge case and being held therein by means of a frontal zone of the cartridge case; said frontal zone comprising a conical case shoulder and an at least substantially cylindrical case neck that has an opening formed at the open front end of the cartridge case, the cartridge case being extended in the forward direction up to and flush with a rear end of the solid projectile and, after insertion of the synthetic resin sleeve, being drawn inwards in the frontal zone to form said conical case shoulder and said at least substantially cylindrical case neck, whereby the shoulder and neck encompass the synthetic resin sleeve in close contact therewith and clean separation of the solid projectile takes place at the open front end of the cartridge case upon firing of the cartridge.

2. The training cartridge of claim 1, wherein the case is made of a metal selected from the group consisting of brass, steel and aluminum.

3. The training cartridge of claim 1, wherein the synthetic resin sleeve is formed of polyethylene or polypropylene.

4. The training cartridge of claim 1, wherein said sleeve has the solid projectile formed at the front end followed towards the rear end with a molded-on neck portion, a shoulder portion and a portion defining a hollow chamber for propellant powder.

5. The training cartridge of claim 4, wherein said molded-on neck portion is surrounded by the case neck, said shoulder portion is engaged by the case shoulder and said hollow chamber is located in the bottom end of the cartridge case.

6. The training cartridge according to claim 1, wherein said sleeve has a hollow neck portion followed by a hollow shoulder portion that has a thickness which is enlarged with respect to the thickness of the neck portion and other rearward located portions of said sleeve to provide a reinforced shoulder over which the cartridge case is drawn into close contact to form said conical case shoulder.

* * * * *